United States Patent [19]

Ueno

[11] Patent Number: 4,557,615

[45] Date of Patent: Dec. 10, 1985

[54] ELECTRONIC TYPEWRITER WITH AUTOMATIC POWER-OFF DEVICE

[75] Inventor: Hideo Ueno, Nagoya, Japan

[73] Assignee: Brother Kogyo Kabushiki Kaisha, Nagoya, Japan

[21] Appl. No.: 737,572

[22] Filed: May 23, 1985

Related U.S. Application Data

[63] Continuation of Ser. No. 599,250, Apr. 11, 1984, abandoned.

[30] Foreign Application Priority Data

Apr. 12, 1983 [JP] Japan ..... 58-65000

[51] Int. Cl.[4] ..... B41J 29/38

[52] U.S. Cl. ..... 400/54; 400/479; 364/519

[58] Field of Search ..... 364/518, 519, 523; 400/54, 479, 668, 669

[56] References Cited

U.S. PATENT DOCUMENTS

| | | | |
|---|---|---|---|
| 3,753,004 | 8/1973 | Dominic | 400/54 X |
| 3,870,138 | 3/1975 | Sato et al. | 400/54 |
| 4,070,587 | 1/1978 | Hanakata | 400/54 X |
| 4,279,523 | 7/1981 | Ringle | 400/54 X |
| 4,306,299 | 12/1981 | Check, Jr. et al. | 364/900 |
| 4,316,246 | 2/1982 | Hartley et al. | 364/200 |

FOREIGN PATENT DOCUMENTS

| | | | |
|---|---|---|---|
| 0126474 | 9/1980 | Japan | 400/54 |
| 0161681 | 12/1980 | Japan | 400/54 |
| 0124977 | 9/1981 | Japan | 400/54 |

OTHER PUBLICATIONS

IBM Tech. Disc. Bulletin, Gruber et al., "Power Saver for Electronic Typewriter," vol. 22, No. 9, Feb. 1980, pp. 4123–4124.

IBM Tech. Disc. Bulletin, Barksdale et al., "Power Saving Feature for Word Processing Systems," vol. 23, No. 10, Mar. 1981, p. 4809.

*Primary Examiner*—Edgar S. Burr
*Assistant Examiner*—James R. McDaniel
*Attorney, Agent, or Firm*—Moonray Kojima

[57] ABSTRACT

In an electronic typewriter adapted to be set in an automatic power off mode, when no key operation is made for a predetermined period of time after the final key operation, the automatic power off mode can be cancelled through operation of a clearing key and the condition based on the key operation finally made, is reset. In the automatic power off mode, the OFF-ON operation of a main switch also cancels the automatic power off mode and resets the condition based on the key operation finally made just before the setting of the automatic power off mode.

4 Claims, 3 Drawing Figures

ELECTRONIC TYPEWRITER WITH AUTOMATIC POWER-OFF DEVICE

This is a continuation of application Ser. No. 06/599,250, filed on 04/11/84, now abandoned.

BACKGROUND OF THE INVENTION

1. Field of Invention

This invention relates to an electronic typewriter having an automatic power-off device, which, when input from a keyboard is interrupted for a predetermined period of time, interrupts automatically all of the power supply to the typewriter, except the power supply necessary for retaining the contents of the memories and for controlling a switch used to cancel the automatic power-off mode.

2. Description of Invention

In conventional electronic typewriters having an automatic power off device, the mode of the typewriter is changed to an automatic power off mode after keyboard operation has been interrupted for a predetermined period of time. It is necessary to operate a special automatic power off cancelling switch, provided in addition to an ordinary main switch, in order to cancel the automatic power off mode. In the automatic power off mode, there is no displaying on the display unit, in addition to the interruption of printing operation.

Thus, the automatic power off mode is indistinguishable, in appearance, from the state wherein the ordinary main switch is turned OFF to interrupt all of the power supply to the electronic typewriter. Consequently, in cancelling the automatic power off mode, the ordinary main switch is liable to be moved to the OFF position accidentally instead of operating the automatic power off cancelling switch. Accordingly, the operation of the ordinary main switch to the OFF position causes erasure of the contents of the memories which have retained data during the automatic power off mode by a backup power source and the return of the print head to the left margin. Disadvantageously, such accidental operation adversely affects the working efficiency.

SUMMARY OF THE INVENTION

Accordingly, an object of the invention is to improve the prior art, and to overcome the aforementioned and other disadvantages and deficiencies of the prior art.

Another object is to provide an electronic typewriter having automatic power off device.

A further object is to provide an electronic typewriter having an automatic power off device which is capable of preventing erasure of the contents of the memories.

A still further object is to provide an electronic typewriter having an automatic power off device which is capable of avoiding problems arising from accidental operation of the ordinary main switch during the automatic power off mode.

Another object is to provide an electronic typewriter having an automatic power off device which is capable of allowing the resetting of the condition existing before the setting of the automatic power off mode, also through an OFF-ON operation of the main switch.

DETAILED DESCRIPTION OF PREFERRED EMBODIMENTS

Figure 1:
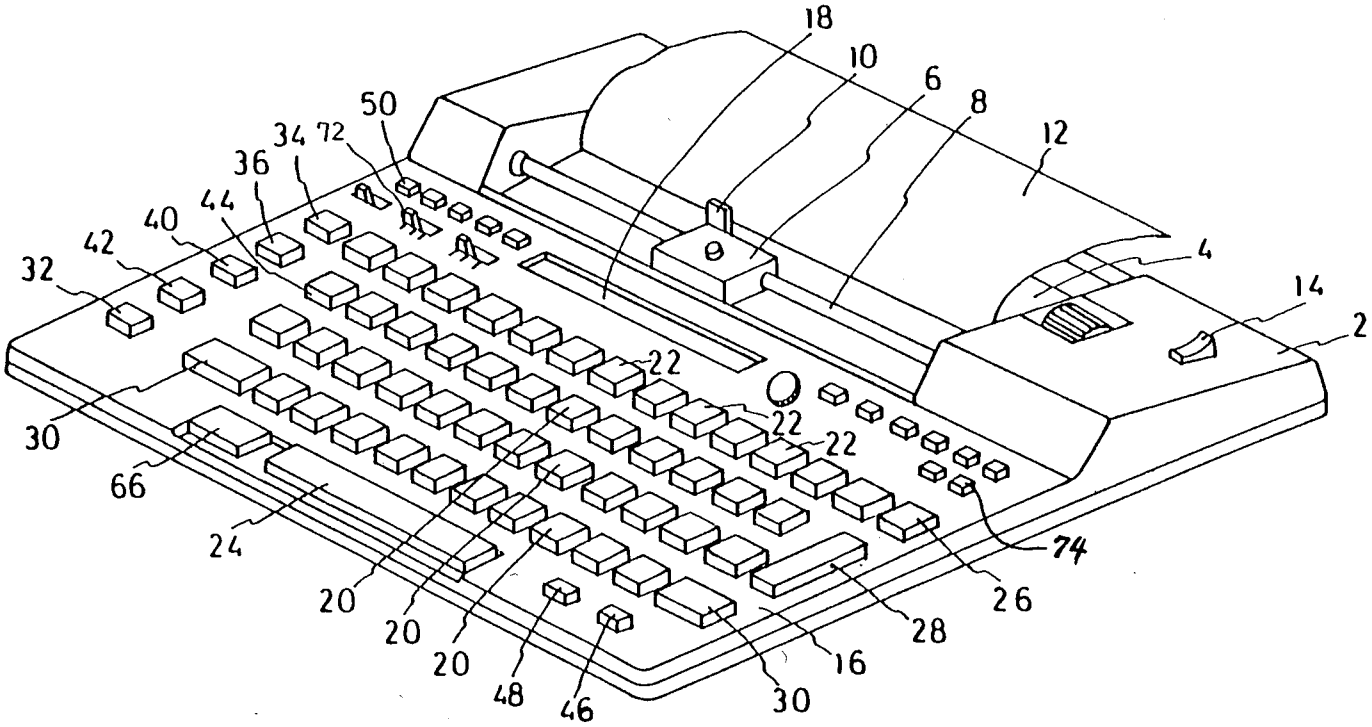
FIG. 1 is a perspective view depicting an electronic typewriter structure embodying the invention.

Turning now to FIG. 1, an illustrative electronic typewriter structure is shown, comprising a body case 2, a platen 4 rotatably supported by body case 2, and a carriage 6 movable in parallel to the rotational center line of platen 4. Carriage 6 is guided by a guide rod 8 supported in parallel to platen 4, by body case 2, and moved in the longitudinal direction of platen 4, by a drive device (not shown). A thermal head, as an exemplary print head, 10 is fixed to carriage 6, and moved along printing line on a thermal sensitive paper 12, as an exemplary printing paper, held on platen 4 when carriage 6 is moved in the manner described. Carriage 6 is further rotated about guide rod 8 by another drive device (not shown), and this rotation moves head 10 between a print position, whereat head 10 is pushed against paper 12, and a separate position, whereat the head 10 is separated from paper 12. Platen 4 is likewise driven to rotate by a drive device (not shown) and feeds paper 12 in the direction perpendicular to the printing line. A power supply switch 14, which is the main power switch, is installed on body case 2.

In front of body case 2 is provided a keyboard 16 which has a display 18, such as of liquid crystal display elements, and is, for example, of 16 columns. On keyboard 16 are further arranged operational members such as keys, changeover switches, knobs and the like, for operating the typewriter. These operational members are, for example, alphabetic keys 20 for entering alphabetic characters; numeric keys 22 for entering numeric characters 1 through 9 and 0; space key 24; back space key 26; carriage return key 28; shift key 30; second shift key 32; left margin setting key 34; right margin setting key 36; tab setting key 40; tab clear key 42; tab key 44; paper feed key 46; paper return key 48; repeat key 50; code key 66; mode selecting switch 72; reset key 74, and the like.

Among the foregoing operational members, code key 66 is a key which is operated together with any of the other mentioned keys, so as to generate code data which is different from that generated when such key is operated solely. The mode selecting switch 72 is a three position type slide switch to select any of three modes, that is, a non-print mode, a collection print mode, and a direct print mode.

The non-print mode is a mode wherein entered characters or arithmetic results are displayed in display 18 without printing each character by head 10. Collection print mode is a mode wherein each character entered is displayed in display 18 and corrected and characters overflowed from display 18 are sequentially printed on paper 12 by head 10. Direct print mode is a mode wherein characters entered are displayed in display 18 and printed on paper 12 by head 10 simultaneously with the entering. Reset key 74 is a key for cancelling the automatic power off mode.

Since the other functions of the other keys are described, for example, in co-pending U.S. patent application Ser. No. 479,810 which is assigned to the same assignee as hereof, a detailed description of these is omitted for simplification of description.

Figure 2:
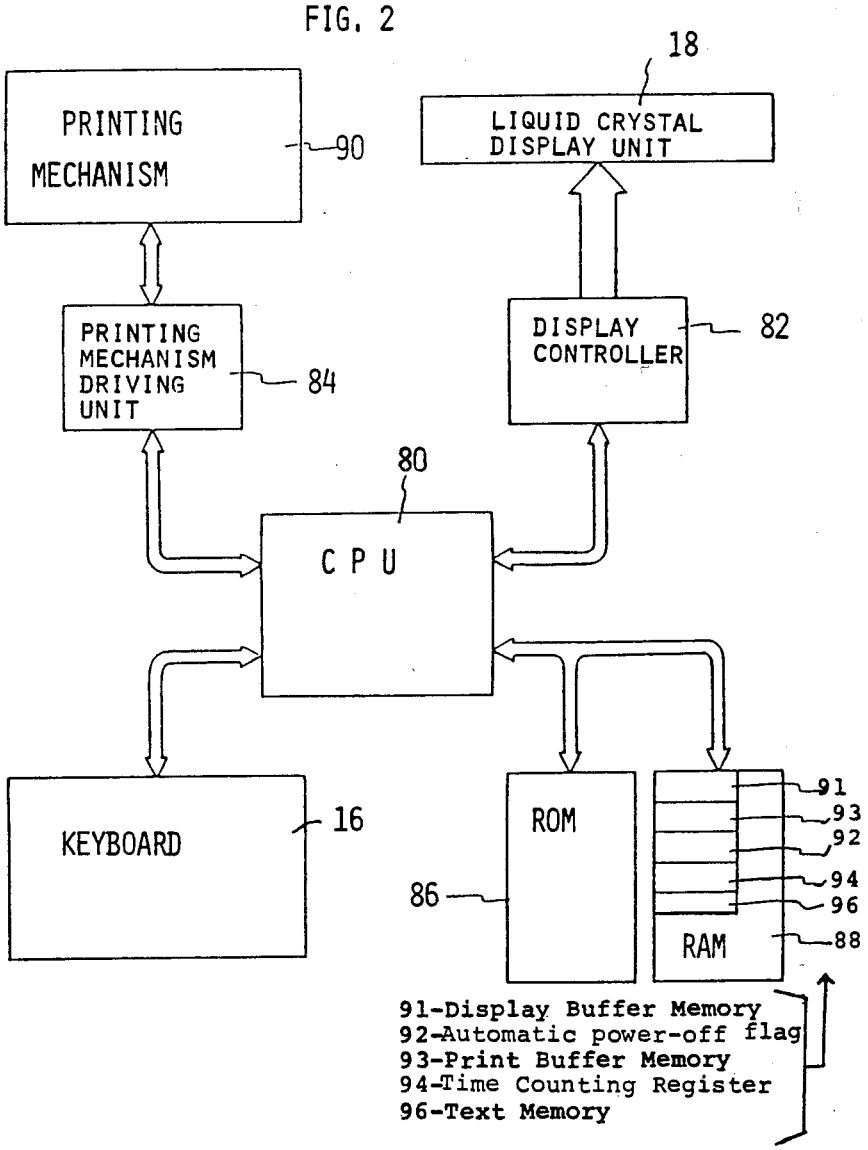
FIG. 2 is a block diagram depicting an electronic circuit used in the embodiment of the invention.

FIG. 2 shows a block diagram of electronic circuit components embodying the invention and used in the typewriter of FIG. 1. FIG. 2 depicts a central processing unit (CPU) 80 which is connected to keyboard 16, display controller 82, printing mechanism driver 84, read only memory (ROM) 86, and random access memory (RAM) 88. Display 18, which is shown as a liquid crystal display unit, is connected to display controller 82 and the two together may be considered to constitute a display unit. A printing mechanism 90 is connected to printing mechanism driver 84, and the two together may be considered to constitute a printing unit. Printing mechanism 90 includes platen 4 and carriage 6, and a drive device (not shown) to drive these units as well as head 10.

RAM 88 is provided with a display buffer 91 having the same number of columns as that of display 18. CPU 80 stores code data in display buffer memory 91, in sequence. The code corresponds to alphabetic and numeric characters, spaces, arithmetic symbols and other symbols, as well as printing control symbols, such as line feed symbol, paper feed symbol and the like, all entered from keyboard 16. CPU 80 reads out pattern data corresponding to the code data from ROM 86 and supplies the code data to display controller 82.

Display controller 82 is provided with a buffer memory having the same number of columns as that of display buffer memory 91 and makes display 18 indicate characters or printing control symbols based on the pattern data fed from CPU 80. RAM 88 is further provided with a printing buffer memory 93 corresponding to 32 characters to store the printing data entered from keyboard 16. Printing mechanism driver 84 drives head 10 of printing mechanism 90 according to the pattern data read out from ROM 86 by CPU 80, based on data stored in printing buffer memory 93. Printing mechanism driver 84 also drives a motor, or the like, (not shown) to drive carriage 6 and platen 4. A program to control the operation of the typewriter, as a whole, is also stored in ROM 86.

RAM 88 is further provided with a text memory 96, which can store about 2 K bytes of data, which are character data and function data, including printing control data.

RAM 88 further comprises an automatic power off flag 92 and a time counting register 94. Time counting register 94 is counted up at fixed time intervals by a clock output signal provided by CPU 80 from the moment of interruption of key operation. Determination is made whether or not the automatic turn off is to be executed on basis of the count of time counting register. The electronic typewriter contains a backup power source, not shown, such as a condenser of a large capacity, capable of backing up (i.e. supplying power to) CPU 80, ROM 86 and RAM 88, while the main switch 14 is turned off.

Figure 3:
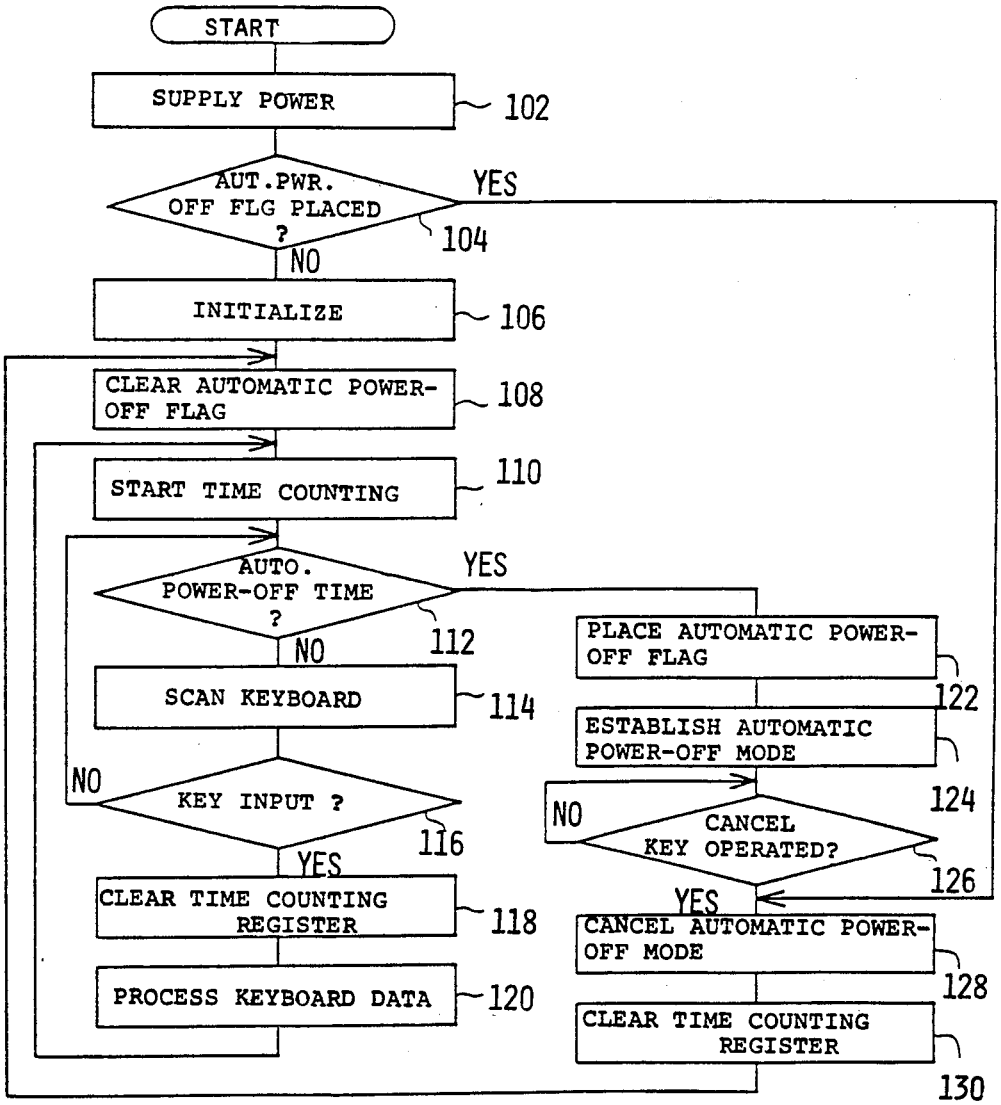
FIG. 3 is a flow chart depicting routines for operating the embodiment.

Operation of the embodiment will now be described with reference to the flow chart of FIG. 3. After the START, when main switch 14 is turned ON, first, power is supplied to all of the components, at Step 102. Then, at step 104, determination is made whether or not an automatic power off flag is marked in RAM 88.

If the determination is NO, namely, no automatic power off flag is marked, an initialization procedure, including resetting of the memories and moving the carriage 6 to the left end position is executed at step 106. Then, at step 108, the automatic power off flag 92, is cleared off. Then, at step 110, time counting operation is started, to count up time counting register 94 of RAM 88, at fixed time intervals by clock output signals provided by CPU 80.

Then, at step 112, determination is made whether or not the count of the time counting register has reached a count corresponding to a time period when the automatic power off mode is to be established. If the count of the time counting register 94 has not yet reached the time when the automatic power off mode is to be established (i.e. NO) the control sequence advances to step 114, whereat key input scanning operation is executed. Then, at step 116, determination is made whether or not any key was operated. If a key was operated (i.e. YES), the control sequence advances to step 118, whereat the count of time counting register 94 is cleared. Then, at step 120, the input data scanned at step 114 is processed. Then, the control sequence is returned again to step 110.

If the determination at step 116 is NO, the control sequence returns again to step 112. If the count of the time counting register 94 was found to correspond to the time period when the automatic power off mode is to be set (i.e. YES), the control sequence advances to step 122, whereat automatic power off flag 92 is set. Then, at step 124, automatic power off process is executed to interrupt power supply to the components, except backup power continues to supply CPU 80, ROM 86 and RAM 88. Then, at step 126, determination is made whether or not reset key 74 which is used for cancelling automatic power off mode and for resetting the status existing just before setting of the automatic power off mode. If the determination is NO, the control sequence returns again to step 126, to retain the present status, namely, automatic power off mode.

On the other hand, if the determination at step 126, is YES, the control sequence advances to the next step 128, whereat automatic power off mode is cancelled and the condition based on the final key operation existing just before the automatic power off mode was made, is reset. Then, at step 130, the count of the time counting register 94 is cleared. Then, the control sequence is returned again to step 108.

On the other hand, if the automatic power off flag 92 is placed at step 104 (i.e. YES) control sequence advances to step 128, whereat automatic power off mode is cancelled and the status existing just before the setting of the automatic power off mode, is reset.

Advantageously, the invention is capable of maintaining data retained in the memory by use of a backup power source, without adversely affecting the same, even if the ordinary main switch is accidently turned OFF during the automatic power off mode, and allowing the status existing just before setting of the automatic power off mode, to be reset by moving the ordinary main switch to the ON position. Thus, the invention improves working efficiency by eliminating erroneous operation in resetting the status existing just before setting the automatic power off mode.

The foregoing description is illustrative of the principles of the invention. Numerous modifications and extensions thereof would be apparent to the worker skilled in the art. All such modifications and extensions are to be considered to be within the spirit and scope of the invention.

What is claimed is:

1. An electronic typewriter with an automatic power off device, comprising a main switch for manually turning ON and OFF power to said typewriter;

a printer having a print head capable of moving along a printing line of a recording sheet;

a keyboard having an arrangement of character keys, function keys and other keys for entering code data corresponding to said keys;

memory means for storing various code data entered from said keyboard;

control means for controlling said printer, said keyboard and said memory means;

a counter under the control of said control means and adapted to be counted up at fixed time intervals and to be cleared each time data is entered by keying operation of said keyboard;

means under the control of said control means and responsive to said counter for setting an automatic power off mode wherein operation of said printer and said keyboard are turned off in response to the content of said counter reaching a predetermined value while continuing operation of said memory means and said control means; and means under the control of said control means and responsive to manual sequential OFF and then ON operation of said main switch during said automatic power off mode for cancelling said automatic power off mode, and for resetting said typewriter including said printer and said memory to a status existing prior to setting of said automatic power off mode, and for activating said typewriter including said printer and said keyboard.

2. The typewriter of claim 1, wherein said automatic power off mode setting means comprises a flag register adapted to be set when content of said counter reaches a predetermined value, and wherein said cancelling means is adapted to be actuated to cancel said automatic power off mode when said automatic power off mode is detected on the basis of content of said flag register.

3. The typewriter of claim 1, wherein said counter counts pulse signals generated at fixed time intervals by said control means.

4. The typewriter of claim 1, wherein said cancelling means comprises an automatic power off mode detecting means adapted to be actuated when said main switch is turned to an ON position, and said cancelling means cancels said automatic power off mode and clears content of said counter, when said detecting means detects said automatic power off mode.

* * * * *